US008305066B2

(12) United States Patent
Lin et al.

(10) Patent No.: US 8,305,066 B2
(45) Date of Patent: Nov. 6, 2012

(54) LOW DROPOUT REGULATOR

(75) Inventors: Chung-Wei Lin, Xinyuan Township (TW); Chien-Yu Chen, Taipei (TW)

(73) Assignee: Industrial Technology Research Institute, Hsinchu (TW)

( * ) Notice: Subject to any disclaimer, the term of this patent is extended or adjusted under 35 U.S.C. 154(b) by 247 days.

(21) Appl. No.: 12/785,980

(22) Filed: May 24, 2010

(65) Prior Publication Data

US 2011/0156674 A1 Jun. 30, 2011

(30) Foreign Application Priority Data

Dec. 31, 2009 (TW) ..... 98146301 A

(51) Int. Cl.
*G05F 1/56* (2006.01)
*G05F 1/569* (2006.01)
*G05F 1/575* (2006.01)

(52) U.S. Cl. ..... 323/285; 323/289

(58) Field of Classification Search ..... 323/277, 323/278, 280, 281, 282, 285, 312, 313, 314, 323/315, 316, 317, 289
See application file for complete search history.

(56) References Cited

U.S. PATENT DOCUMENTS 5,245,523 A * 9/1993 Juzswik ..... 363/56.03
5,600,234 A * 2/1997 Hastings et al. ..... 323/282
5,917,319 A * 6/1999 Frank et al. ..... 324/76.11
6,300,749 B1 * 10/2001 Castelli et al. ..... 323/273
6,600,299 B2 * 7/2003 Xi ..... 323/280
6,603,292 B1 * 8/2003 Schouten et al. ..... 323/277
7,015,680 B2 * 3/2006 Moraveji et al. ..... 323/274
7,102,342 B2 * 9/2006 Kim ..... 323/316
7,129,686 B1 * 10/2006 Huang ..... 323/313
7,224,155 B2 * 5/2007 Bo et al. ..... 323/312

(Continued)

FOREIGN PATENT DOCUMENTS

WO 2009/036004 A2 3/2009

OTHER PUBLICATIONS

W. J. Huang, Capacitor-Free Low Dropout Regulators Using Nested Miller Compensation With Active Resistor and 1-bit Programmable Capacitor Array, IET Circuits, Devices, & Systems, 2008, vol. 2, No. 3, pp. 306-316.

(Continued)

*Primary Examiner* — Gary L Laxton
*Assistant Examiner* — Nusrat Quddus
(74) *Attorney, Agent, or Firm* — Wang Law Firm, Inc.; Li K. Wang; Stephen Hsu

(57) ABSTRACT

A low dropout regulator having a power transistor, a current-voltage converting circuit, a current variation sensing circuit and a compensation circuit is provided. The power transistor has a power terminal receiving an input voltage, a control terminal, and an output terminal coupled to the current-voltage converting circuit to generate an output voltage. The current variation sensing circuit provides a first and a second output terminal and, according to a current variation of the power transistor, the first and second output terminals vary with distinct voltage transition speeds. The compensation circuit controls the control terminal of the power transistor to adjust the output voltage according to a first voltage difference between a feedback of the output voltage and a reference voltage and a second voltage difference between the second and first output terminals of the current variation sensing circuit.

16 Claims, 9 Drawing Sheets

U.S. PATENT DOCUMENTS

| | | | | |
|---|---|---|---|---|
| 7,285,942 | B2 | 10/2007 | Man et al. | |
| 7,323,854 | B2 * | 1/2008 | Ritter | 323/280 |
| 7,436,244 | B2 * | 10/2008 | Lin | 327/539 |
| 7,557,557 | B2 * | 7/2009 | Sugie et al. | 323/316 |
| 7,615,977 | B2 * | 11/2009 | Gicquel et al. | 323/273 |
| 7,656,224 | B2 * | 2/2010 | Perez et al. | 327/540 |
| 7,808,068 | B2 * | 10/2010 | Hartley | 257/467 |
| 2008/0094045 | A1 * | 4/2008 | Lin | 323/274 |
| 2008/0157735 | A1 * | 7/2008 | Liu et al. | 323/280 |
| 2008/0284394 | A1 * | 11/2008 | Yin et al. | 323/282 |
| 2009/0001953 | A1 | 1/2009 | Huang | |
| 2009/0128104 | A1 * | 5/2009 | Mandal | 323/273 |
| 2009/0295353 | A1 * | 12/2009 | De Lima Filho et al. | 323/284 |
| 2010/0127684 | A1 * | 5/2010 | Iliasevitch | 323/285 |
| 2010/0134086 | A1 * | 6/2010 | Theil et al. | 323/312 |
| 2010/0289475 | A1 * | 11/2010 | Lipka | 323/315 |

OTHER PUBLICATIONS

Jiann-Jong Chen, et al., A Capacitor-Free Fast-Transient-Response LDO With Dual-Loop Controller Paths, IEEE Asian Solid-State Circuits Conference, pp. 364-367, Nov. 12-14, 2007, Jeju, Korea.

Robert J. Milliken, et al., Full On-Chip CMOS Low-Dropout Voltage Regulator, IEEE Transactions on Circuits and Systems, vol. 54, No. 9, Sep. 2007, pp. 1879-1890.

* cited by examiner

LOW DROPOUT REGULATOR

CROSS REFERENCE TO RELATED APPLICATIONS

This Application claims priority of Taiwan Patent Application No. 098146301, filed on Dec. 31, 2009, the entirety of which is incorporated by reference herein.

BACKGROUND OF THE INVENTION

1. Field of the Invention

The present invention relates to low dropout regulators (LDO regulators).

2. Description of the Related Art

A LDO regulator is a common solution for power management of portable electronic devices (such as a mobile phone, personal digital assistant, digital camera, or notebook).

FIG. 1 depicts an embodiment of a conventional LDO regulator. The LDO regulator 100 comprises a power transistor Mp, a current-voltage converting circuit 102, an error amplifier 104, and a capacitor Cout coupled to the output terminal of the LDO regulator 100. The power transistor Mp of the LDO regulator 100 has a power terminal (for example, a source of the transistor Mp), which receives an input voltage Vin that is activated by an input voltage Vin and controlled according to the state of the control terminal (gate) of the power transistor Mp. A current is generated at the output terminal (drain) of the power transistor Mp. A portion of the current is sent to the current-voltage converting circuit 102 to be converted to an output voltage Vout to drive a load 110. The output voltage Vout may be divided to a feedback voltage Vfb to be transmitted to the error amplifier 104 to be compared with a reference voltage Vref. The output of the error amplifier 104 controls the voltage level of a control terminal (gate) of the power transistor Mp to maintain the value of the output voltage Vout.

However, the value of the output voltage Vout may be affected by a load current Iload of the load 110. FIG. 2 shows the waveforms of the load current Iload and the output voltage Vout. As shown, the output voltage Vout may vibrate (an undershoot 202 or an overshoot 204) according to variations at the load current Iload. In the circuit of FIG. 1, the capacitor Cout is designed to ensure the stability of the close-loop control of FIG. 1. Thus, the capacitor Cout should be large-sized, so that the vibrations of the undershoot 202 and the overshoot 204 are limited within an acceptable region. However, circuit area for a large-sized capacitor Cout is large. For power management of a chip, the capacitor Cout has to be designed as an external capacitor which is outside of the chip, while the other components of the LDO regulator may be designed within the chip. Thus, an additional pad is required for the external capacitor (Cout), which increases chip costs.

BRIEF SUMMARY OF THE INVENTION

The invention discloses low dropout regulators (LDO regulators) without large-sized external capacitors. The transient response of the LDO regulator is stable and fast. The LDO regulator can handle inputs with higher voltage levels in comparison with conventional regulators.

An exemplary embodiment of the LDO regulator comprises a power transistor, a current-voltage converting circuit, a current variation sensing circuit and a compensating circuit. The LDO regulator can convert an input voltage to an output voltage to drive a load.

In an exemplary embodiment, the power transistor has a power terminal, a control terminal and an output terminal. The LDO regulator receives the input voltage via the power terminal of the power transistor. The output terminal of the power transistor is coupled to the current-voltage converting circuit to generate the output voltage of the LDO regulator. The current variation sensing circuit and the compensating circuit are designed to the stability and the response speed of the LDO regulator.

The current variation sensing circuit has an input terminal coupled to the power transistor, and has a first output terminal and a second output terminal. According to the current variation of the power transistor, the current variation sensing circuit generates a first voltage variation and a second voltage variation, respectively, at the first and second output terminals of the current variation sensing circuit. The first and second voltage variations vary at different speeds.

According to a first voltage difference between a feedback of the output voltage of the LDO regulator and a reference voltage and a second voltage difference between the second and first output terminals of the current variation sensing circuit, the compensating circuit controls the voltage level of the control terminal of the power transistor to adjust the output voltage of the LDO regulator.

A detailed description is given in the following embodiments with reference to the accompanying drawings.

BRIEF DESCRIPTION OF THE DRAWINGS

The present invention can be more fully understood by reading the subsequent detailed description and examples with references made to the accompanying drawings, wherein.

DETAILED DESCRIPTION OF THE INVENTION

The following description shows several exemplary embodiments carrying out the invention. This description is made for the purpose of illustrating the general principles of the invention and should not be taken in a limiting sense. The scope of the invention is best determined by reference to the appended claims.

Figure 1:
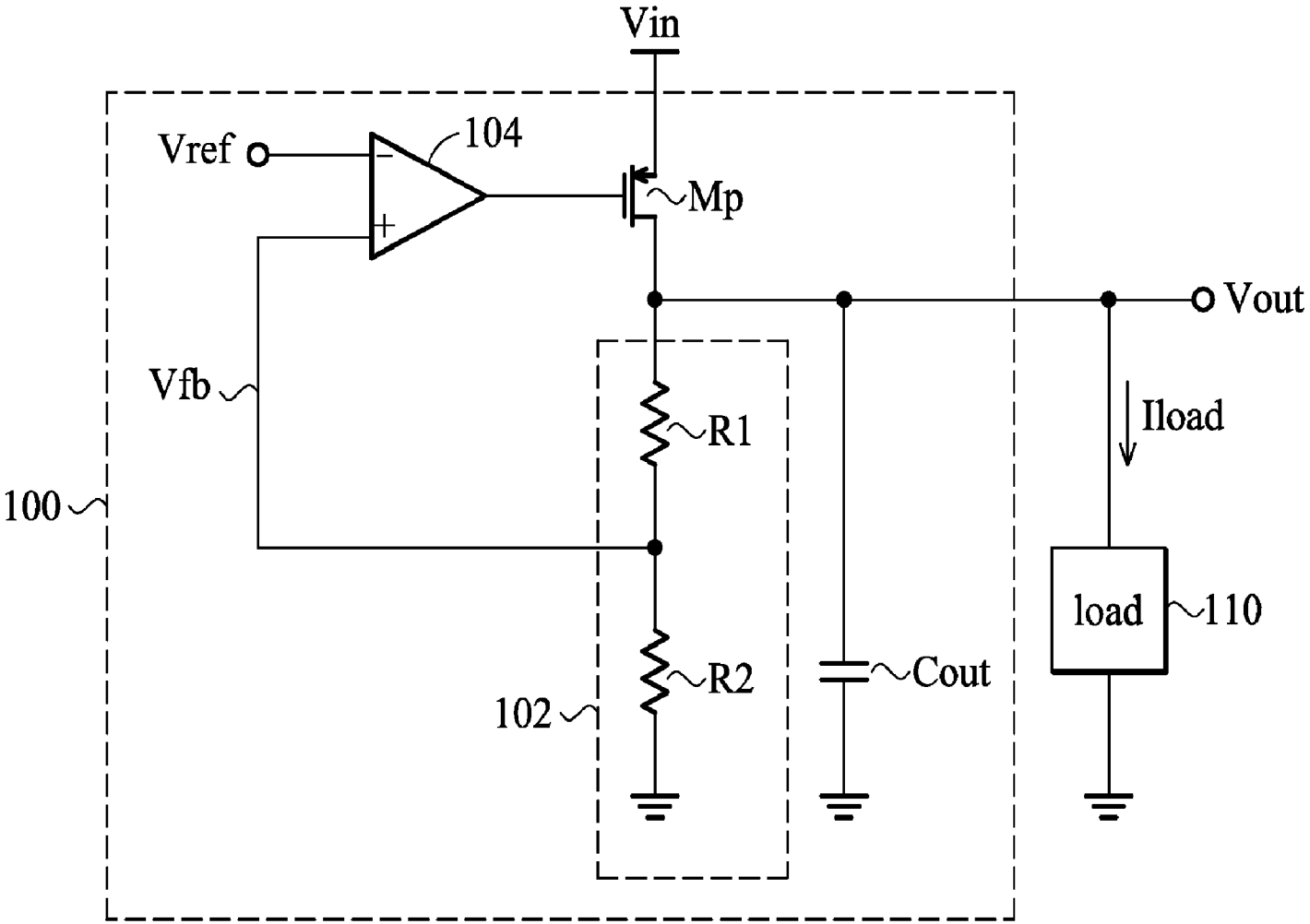
FIG. 1 (PRIOR ART)
FIG. 1 depicts an embodiment of a conventional LDO regulator.
Figure 2:
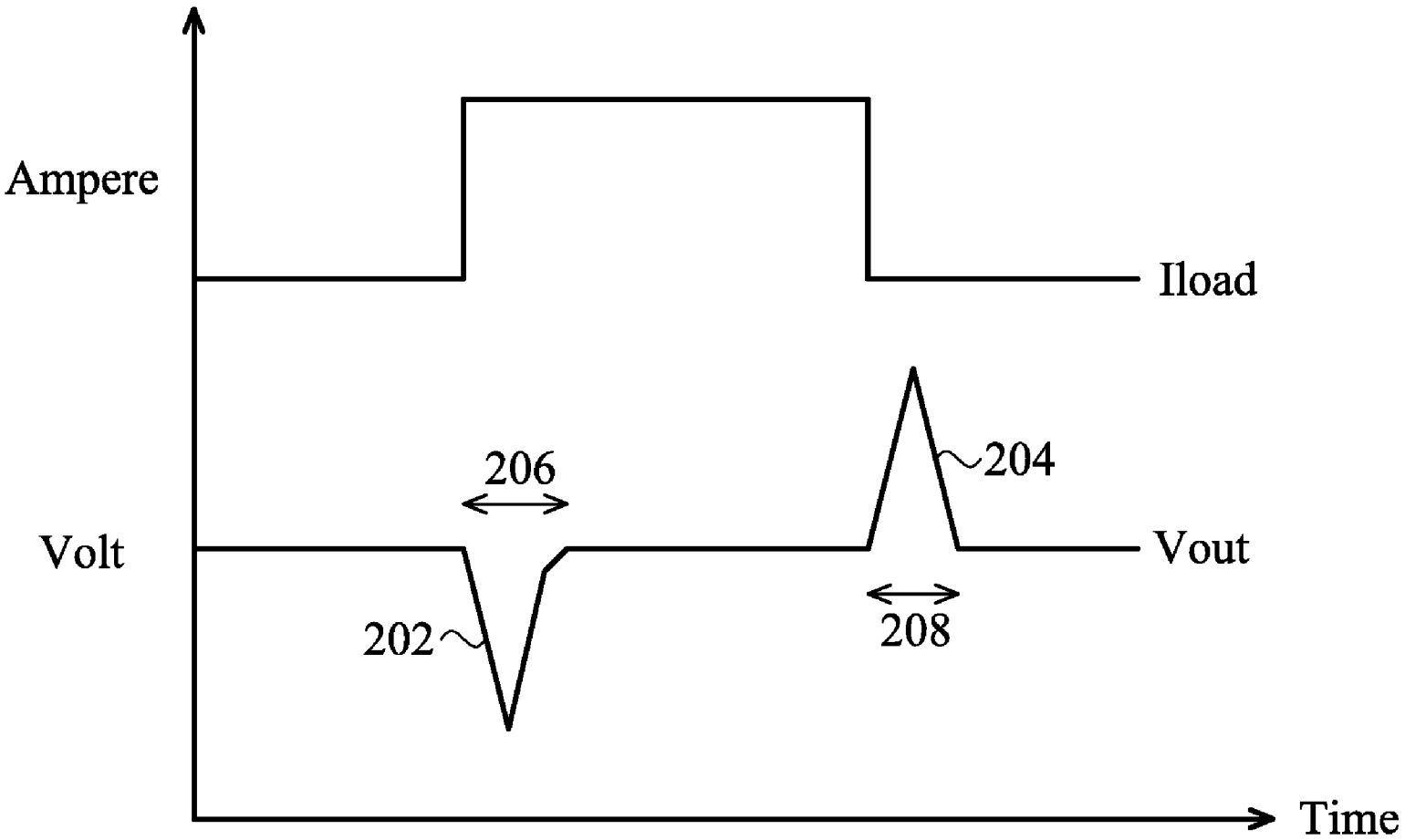
FIG. 2 (PRIOR ART)
FIG. 2 shows the waveforms of the load current Iload and the output voltage Vout of FIG. 1.
Figure 3:
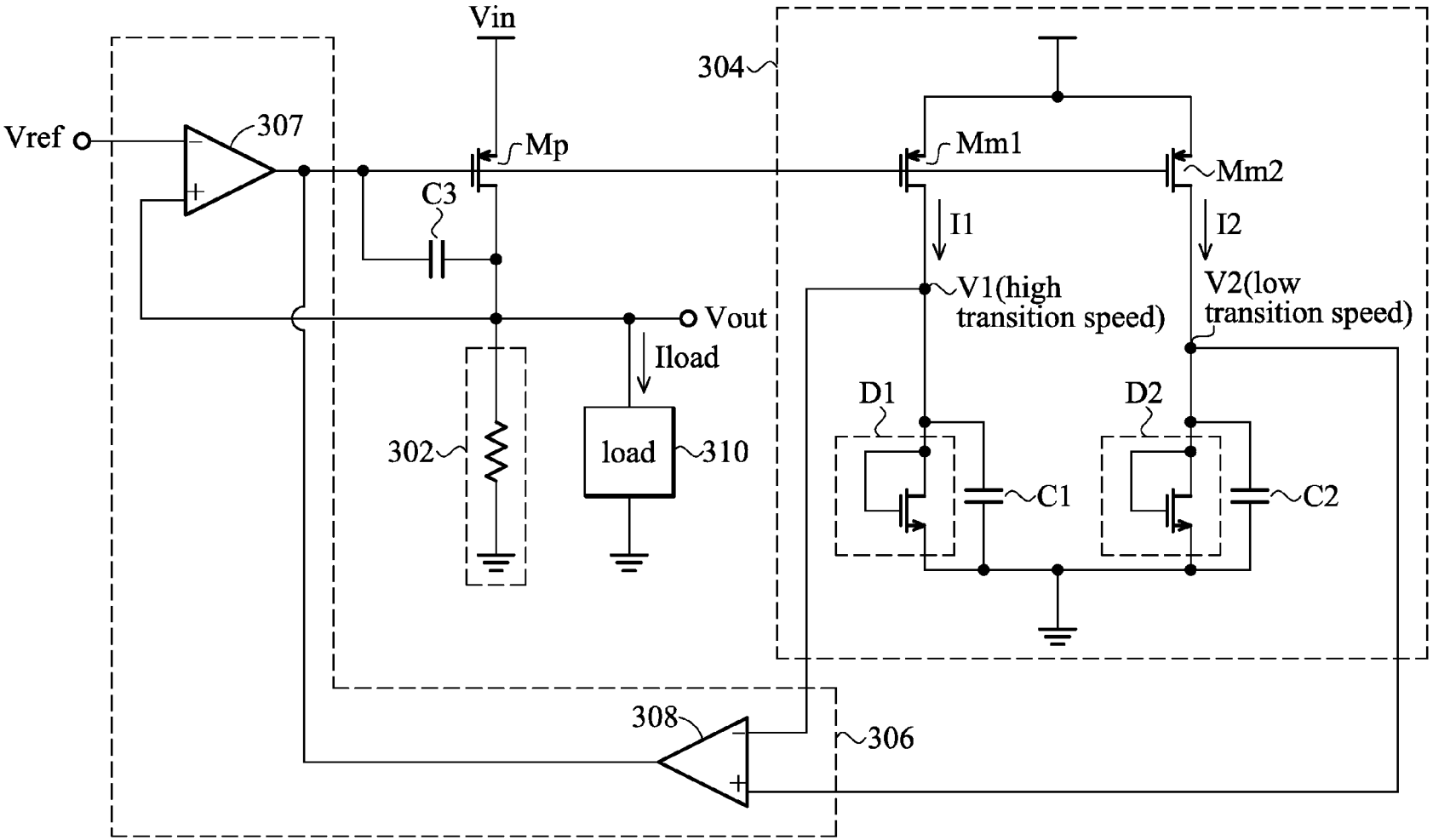
FIG. 3 depicts an exemplary embodiment of the LDO regulators of the invention.

FIG. 3 depicts an exemplary embodiment of the LDO regulators of the invention. As shown, the LDO regulator comprises a power transistor Mp, a current-voltage converting circuit 302, a current variation sensing circuit 304 and a compensating circuit 306. The compensating circuit 306 comprises a first error amplifier 307 and a second error amplifier 308. The LDO regulator converts an input voltage Vin to an output voltage Vout to drive a load 310.

Referring to the embodiment shown in FIG. 3, the power transistor Mp may be a P channel transistor, having a power terminal (source), a control terminal (gate) and an output terminal (drain). As shown, the power terminal (source of Mp) receives input voltage Vin, and the output terminal (drain of Mp) is coupled to the current-voltage converting circuit 302. The current-voltage converting circuit 302 receives current from the power transistor Mp and converts the received current to output voltage Vout.

The current variation sensing circuit 304 and the compensating circuit 306 are designed to maintain stability and response speed of the LDO regulator. The current variation sensing circuit 304 has an input terminal coupled to the power transistor Mp and has a first output terminal V1 and a second voltage terminal V2. A current variation of the transistor Mp can be reflected on the first and second output terminals V1 and V2. In detail, according to the current variation of the first power transistor Mp, the current variation sensing circuit 304 generates a first voltage variation and a second voltage variation at the first and second output terminals V1 and V2, respectively, and the first and second voltage variations are designed to have distinct transition speeds. The compensating circuit 306 controls the control terminal (gate) of the power transistor Mp based on a first voltage difference between a feedback of the output voltage Vout and a reference voltage Vref as well as a second voltage difference between the second and first output terminals V2 and V1 of the current variation sensing circuit 304. This design allows the LDO regulator to operate stably, with high speed transient response.

FIG. 3 further shows an embodiment of the compensating circuit of the invention. As the compensating circuit 306 shows, it comprises a first error amplifier 307 and a second error amplifier 308. The first error amplifier 307 has a first input terminal (non-inverting input) coupled to the output of the LDO regulator to obtain a feedback of the output voltage Vout, and has a second input terminal (inverting input) receiving a reference voltage Vref, and has an output terminal coupled to the control terminal (gate) of the power transistor Mp. The second error amplifier 308 has a first input terminal (non-inverting input) coupled to the second output terminal V2 of the current variation sensing circuit 304, a second input terminal (inverting input) coupled to the first output terminal V1 of the current sensing circuit 304, and an output terminal coupled to the control terminal (gate) of the power transistor Mp.

In addition to the first error amplifier 307 which provides a first feedback path, the LDO regulator of the invention further uses the current variation sensing circuit 304 and the second error amplifier 308 to form a second feedback path. The current variation sensing circuit 304 detects how the load current (Iload) variation is affecting the current of power transistor Mp and, accordingly, the second error amplifier 308 controls the control terminal (gate) of the power transistor Mp to compensates for the current variations. The dual path feedback improves stability and transient response of the LDO regulator without using large-sized capacitors. The multiple error amplifiers (including the first and second error amplifiers 307 and 308) allow the LDO regulator to receive an input voltage Vin of a higher voltage level in comparison with conventional techniques.

Figure 4:
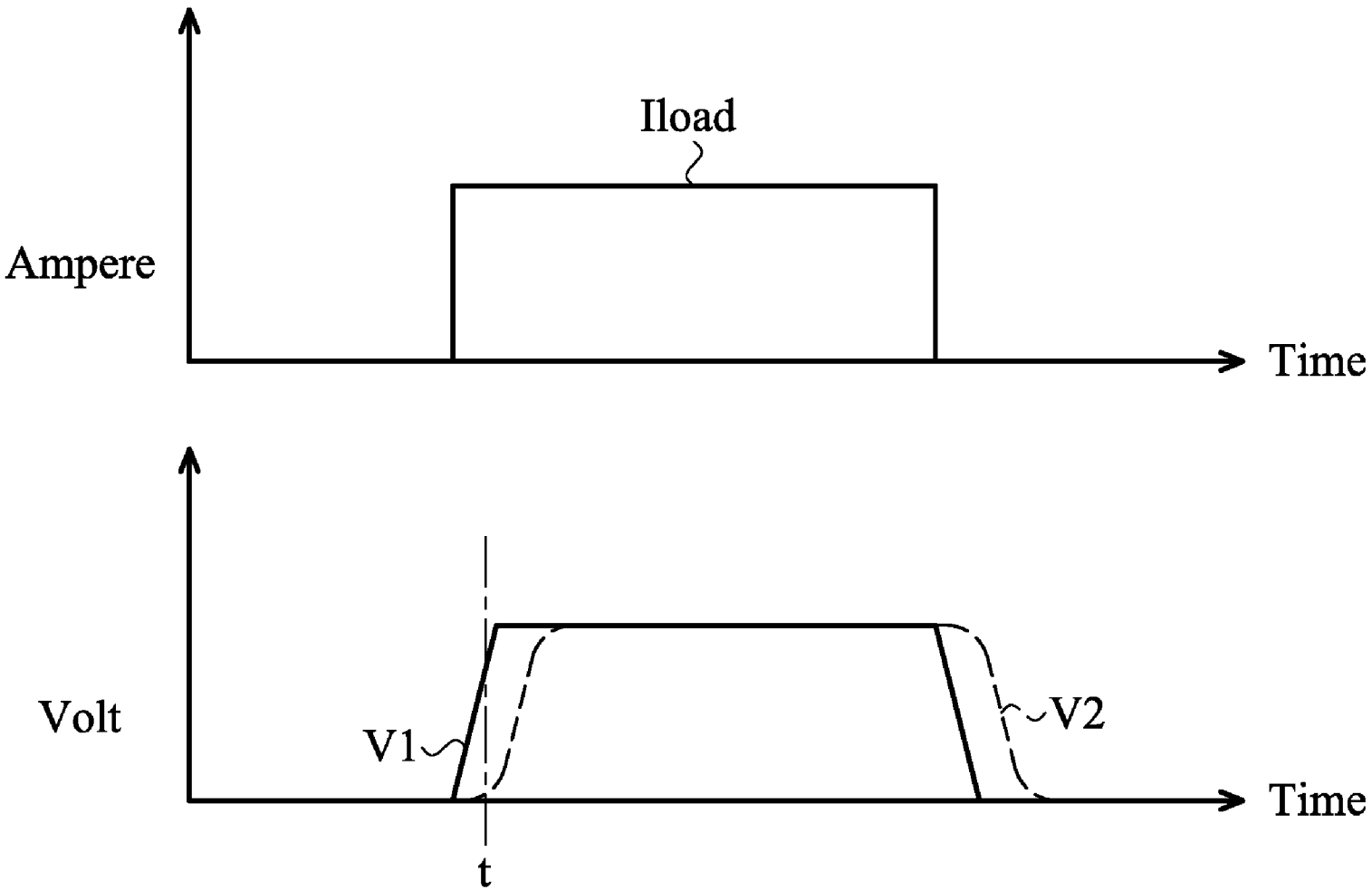
FIG. 4 shows waveforms of several signals of FIG. 3, including the load current Iload and the voltage levels of the first and second output terminals V1 and V2 of the current variation sensing circuit 304.

This paragraph discusses an exemplary embodiment of the current variation sensing circuit. As shown, the current variation sensing circuit 304 comprises a first current mirroring transistor Mm1, a second current mirroring transistor Mm2, a first diode D1, a first capacitor C1, a second diode D2 and a second capacitor C2. The first and second current mirroring transistors Mm1 and Mm2 are coupled to the power transistor Mp to generate a first and a second current I1 and I2 according to the current of the power transistor Mp, For example, the first and second current mirroring transistors Mm1 and Mm2 and the power transistor Mp are coupled in a current mirror structure. The first diode D1 and the first capacitor C1, coupled in parallel between the first current mirroring transistor Mm1 and ground, receive the current I1. The terminal connecting the first diode D1, the first capacitor C1 and the first current mirroring transistor Mm1 together operates as the first output terminal V1 of the current variation sensing circuit 304. The second diode D2 and the second capacitor C2, coupled in parallel between the second current mirroring transistor Mm2 and the ground, receives the current 12. The terminal connecting the second diode D2, the second capacitor C2 and the second current mirroring transistor Mm2 operates as the second output terminal V2 of the current variation sensing circuit 304. Due to designed sizes of the components Mm1, Mm2, D1, C1, D2, and C2, a first voltage variation and a second voltage variation, of different transition speeds, may be generated at the first and second output terminals V1 and V2 of the current variation sensing circuit 304 current varies at the power transistor Mp. For example, the circuit may be formed by identical first and second current mirroring sensing transistors Mm1 and Mm2 and identical first and second diodes D1 and D2 while the size of the first capacitor C1 is smaller than that of the second capacitor C2. In this example, the first voltage variation at the first output terminal V1 of the current variation sensing circuit 304 varies at a higher speed than the second voltage variation at the second output terminal V2 of the current variation sensing circuit 304. FIG. 4 shows waveforms of the load current Iload and the voltage levels of the first and second output terminals V1 and V2 of the current variation sensing circuit 304. The current variations of the load current Iload may be caused by resistance change of the load 310. When detecting the variation of the load current load, the current variation sensing circuit 304 generates variations, in different transition speed, at the first and second output terminals V1 and V2. As shown, the transition speed of V1 is faster than that of V2. There is a voltage difference between V1 and V2. The second error amplifier 308 of FIG. 3 is designed to control the control terminal (gate) of the power transistor Mp according to the voltage difference between V1 and V2.

The embodiment of FIG. 3 further introduces a capacitor C3 for Miller compensation. The capacitor C3 is coupled between the control terminal (gate) and the output terminal (drain) of the power transistor Mp.

Figure 5:
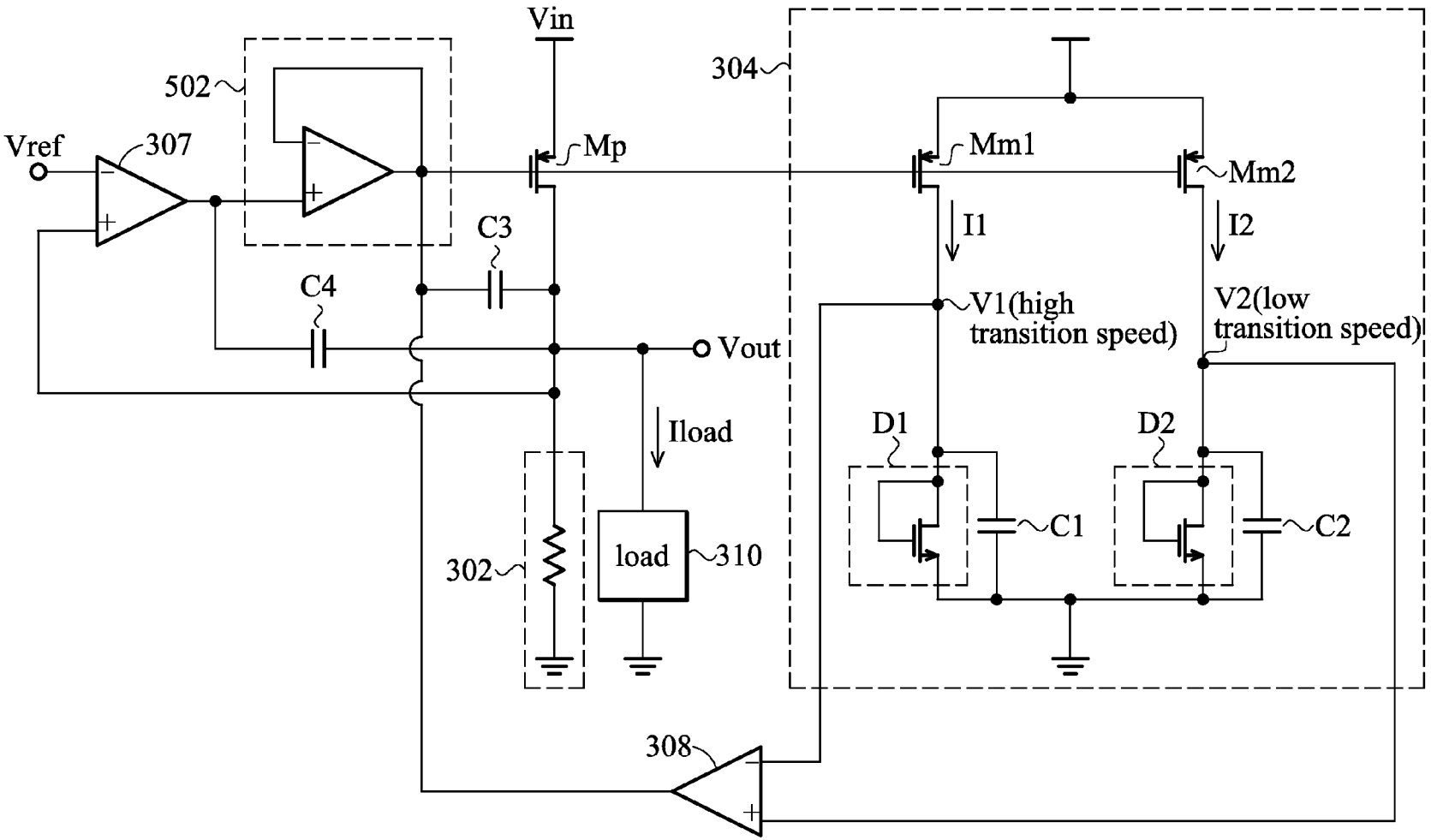
FIG. 5 shows another exemplary embodiment of the LDO regulator.

FIG. 5 shows another exemplary embodiment of the LDO regulator. In comparison with FIG. 3, the LDO regulator of FIG. 5 further discloses a buffer 502, which buffers the output of the first error amplifier 307 and then outputs the buffered signal to be combined with the output of the second error amplifier 308 for the control of the control terminal (gate) of the power transistor Mp. The LDO regulator of FIG. 5 further introduces a fourth capacitor C4 which is formed with the third capacitor C3 for Nested Miller compensation. The third capacitor C3 is coupled between the control terminal (gate) and output terminal (drain) of the power transistor Mp while the fourth capacitor C4 is coupled between the input terminal of the buffer 502 and the output terminal (drain) of the power transistor Mp.

Figure 6A:
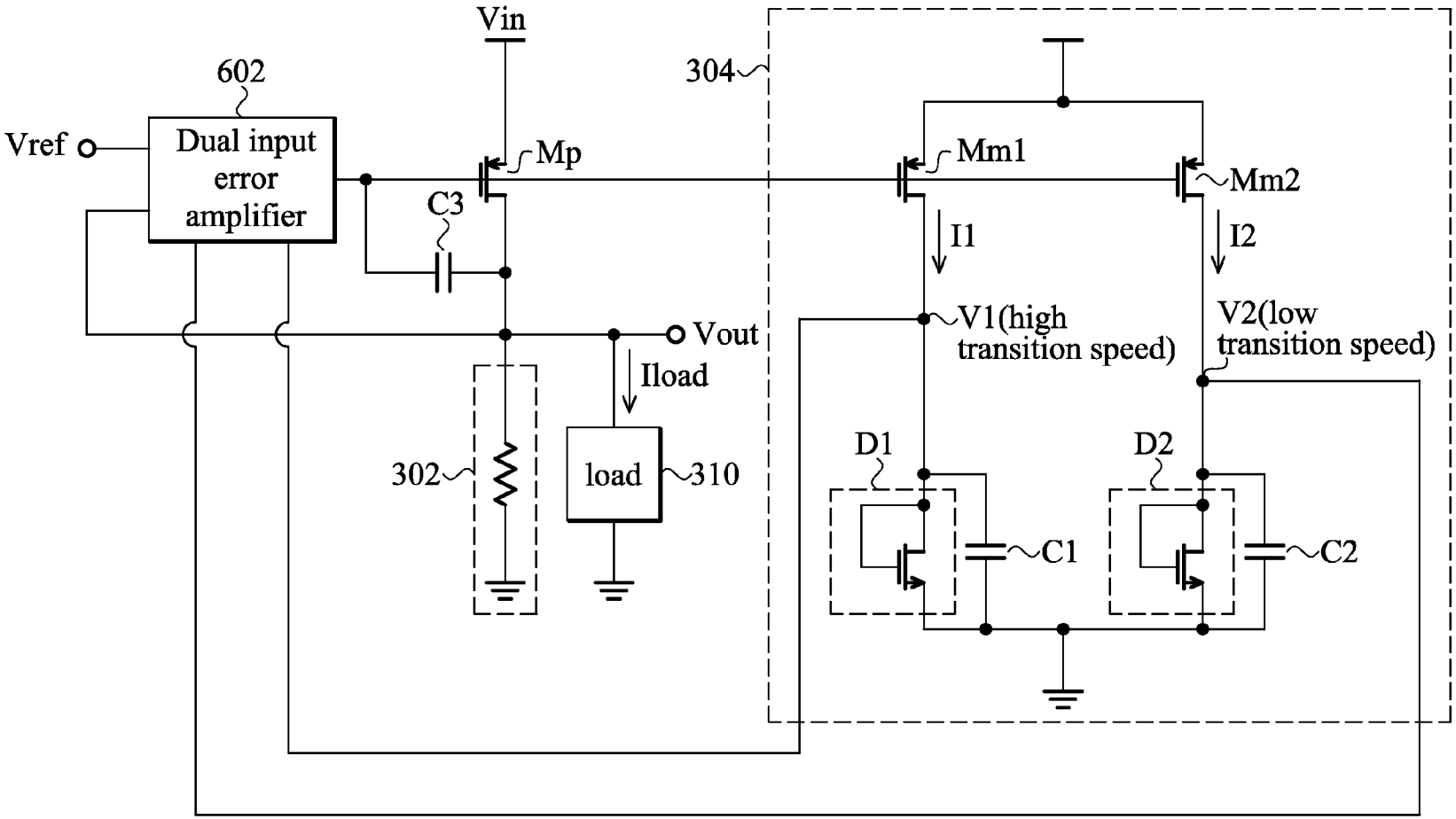
FIGS. 6A and 6B depict another exemplary embodiment of the LDO regulator.
Figure 6B:
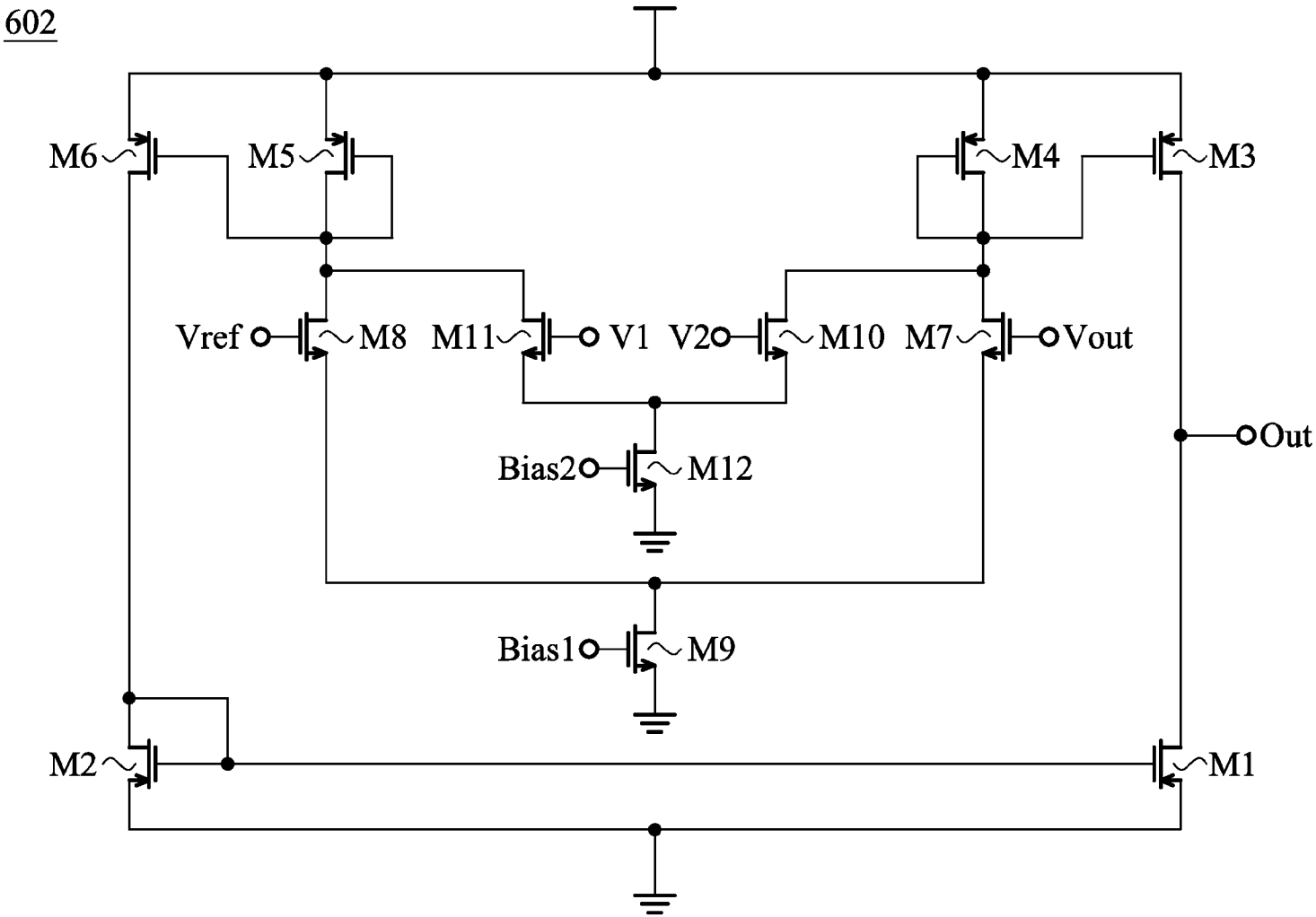

FIGS. 6A and 6B depict another exemplary embodiment of the LDO regulator. In the embodiment shown in FIG. 3. the first and second error amplifiers 307 and 308 are separately designed circuits. The first error amplifier 307 is designed for the signal amplifying of a first voltage difference between signals Vout and Vref while the second error amplifier 308 is designed for the signal amplifying of a second voltage difference between the voltage levels at terminals V1 and V2. However, in the embodiment of FIGS. 6A and 6B, a dual input error amplifier 602 is disclosed to replace the separately designed first and second error amplifiers 307 and 308. In the dual input error amplifier 602, the circuit amplifying the first voltage difference (between signals Vout and Vref) overlaps with the circuit amplifying the second voltage difference (between V2 and V1). FIG. 6B depicts an embodiment of the dual input error amplifier 602. In addition to the transistors M1 . . . M9 (forming a basic error amplifier). the dual input error amplifier 602 further comprises transistors M10 . . . M12. The gates of the transistors M7 and M8 are first and second input terminals of the dual input error amplifier 602, receiving the first pair of inputs Vout and Vref. The gates of the transistors M10 and M11 are the third and fourth input terminals of the dual input error amplifier 602, receiving the second pair of inputs V2 and V1. The first pair of inputs Vout and Vref and the second pair of inputs V2 and V1 share a current mirror circuit (consisting of the transistors M1 . . . M6) that is designed to amplify voltage differences. As shown, the amplified voltage difference between the first pair of inputs (Vout and Vref) and the amplified voltage difference between the second pair of inputs (V2 and V1) are combined at an output terminal Out of the dual error amplifier 602. Note that the circuit shown in FIG. 6B is not intended to limit the structure of the dual error amplifier. In other embodiments, the dual input error amplifier may be implemented by any circuit using overlapped components to amplify a first difference between a first pair of inputs and a second difference between a second pair of inputs.

Figure 7:
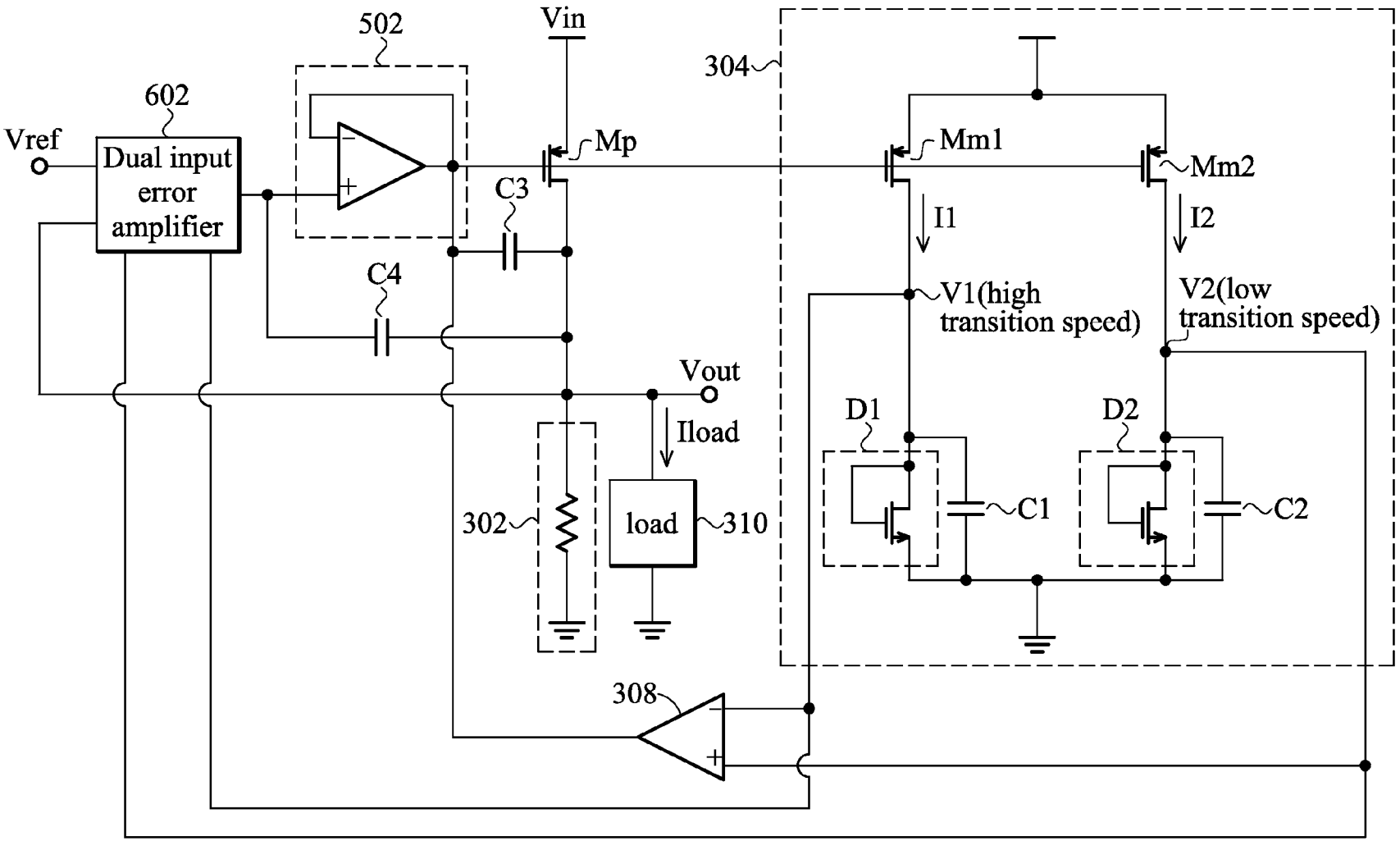
FIG. 7 shows another exemplary embodiment of the LDO regulator.

In other embodiments, the second error amplifier 308 of FIG. 3 or the buffer 502 of FIG. 5 may be deployed in an LDO regulator having the dual input error amplifier 602. Various compensation circuits, controlling the control terminal (gate) of the power transistor Mp, are available according to the description of the specification. FIG. 7 depicts an LDO regulator including a buffer 502, a second amplifier 308, a dual input error amplifier 602, and capacitors C3 and C4. As shown, the fourth capacitor C4 is coupled between the input terminal of the buffer 502 and the output terminal (drain) of the power transistor Mp. The capacitors C3 and C4 provide Nested Miller compensation in the LDO regulator. The capacitor C3, in the circuit, is an optional component while the capacitor C4 is not. All compensation circuits configured by said components are within the scope of the invention.

When the LDO regulator is applied to power management systems of portable electronic devices, the load 310 may be a circuit within a chip. Because the range of the capacitance of the capacitors C1, C2, C3 and C4 is limited to a reasonable value, the first, second third and fourth capacitors C1, C2, C3 and C4 can be on-chip capacitors manufactured within the chip.

Figure 8:
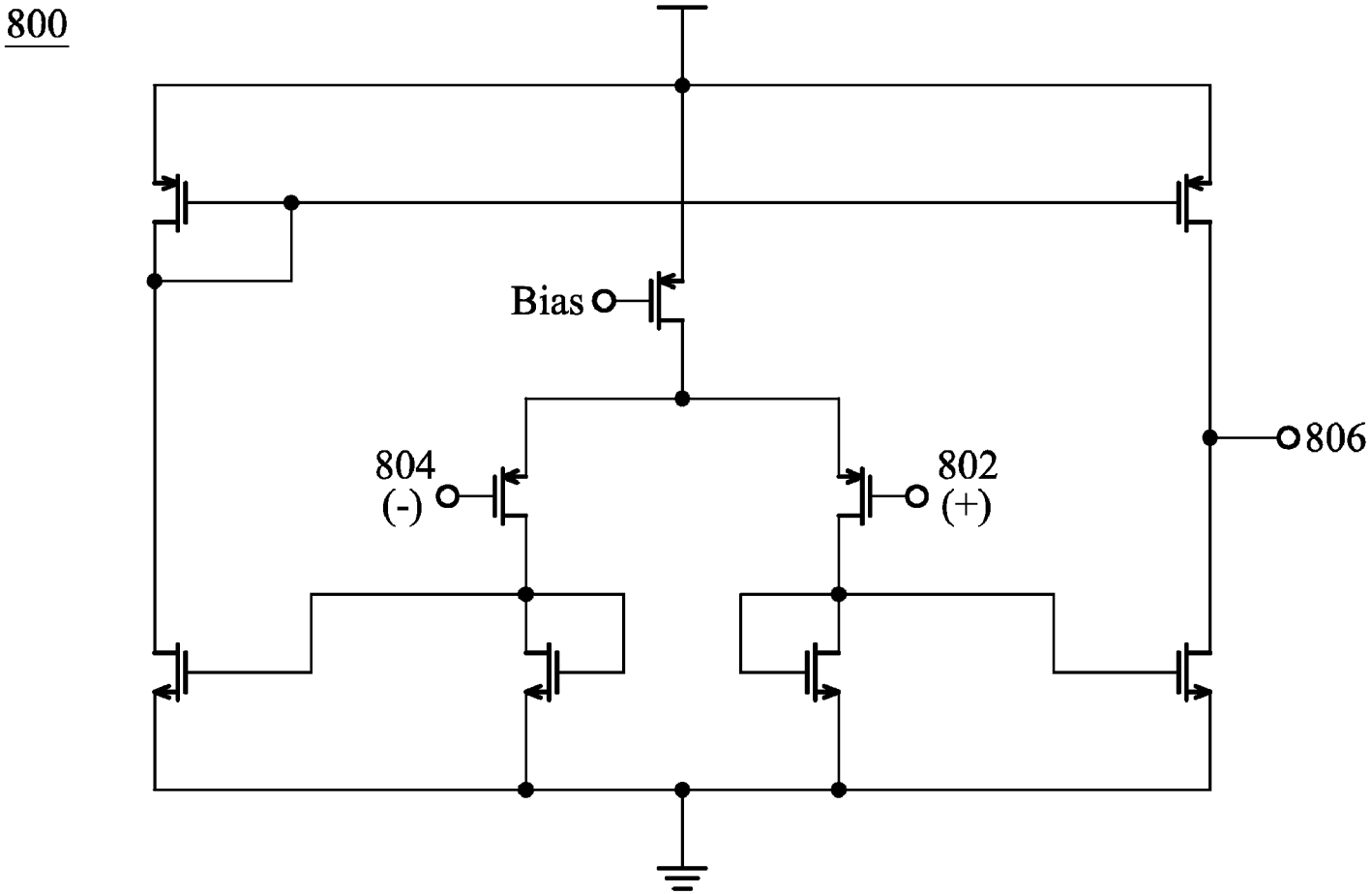
FIG. 8 depicts a p-type Class AB amplifier implementing the second error amplifier 308 or the amplifier of the buffer 502.

This paragraph discusses the second error amplifier 308 and the amplifier of the buffer 502. FIG. 8 depicts an exemplary embodiment of the second error amplifier 308 or the amplifier of the buffer 502, which is a p-type Class AB amplifier. As shown, the amplifier is biased by a voltage Bias, has a first and a second input terminal 802 and 804 and an output terminal 806. The first and second input terminals 802 and 804 operate as a non-inverting input terminal and an inverting input terminals of the amplifier, respectively. p-type Class AB amplifier shown in FIG. 8 can effectively speed up the voltage adjusting speed on the control terminal (gate) of the power transistor Mp of the LDO regulator.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A low dropout regulator, converting an input voltage to an output voltage to drive a load, comprising:

a power transistor, having a power terminal, a control terminal and an output terminal, wherein the power terminal receives the input voltage;

a current-voltage converting circuit, coupled to the output terminal of the power transistor to convert a received current to the output voltage;

a current variation sensing circuit, having an input terminal coupled to the power transistor, and having a first output terminal and a second output terminal, and generating a first voltage variation and a second voltage variation at the first and the second output terminals, respectively, wherein the first and second voltage variations are generated according to a current variation of the power transistor and are of different transition speeds; and a compensating circuit, controlling the control terminal of the power transistor according to a first voltage difference between a feedback of the output voltage and a reference voltage and a second voltage difference between the second and the first output terminals of the current variation sensing circuit, wherein the current variation sensing circuit further comprises:

a first current mirroring transistor and a second current mirroring transistor, each coupled to the power transistor to mirror current of the power transistor;

a first diode and a first capacitor coupled in parallel between the first current mirroring transistor and a fixed voltage terminal, wherein the first diode, the first capacitor and the first current mirroring transistor are connected at the first output terminal of the current variation sensing circuit; and a second diode and a second capacitor coupled in parallel between the second current mirroring transistor and the fixed voltage terminal, wherein the second diode, the second capacitor and the second current mirroring transistor are connected at the second output terminal of the current variation sensing circuit.

2. The low dropout regulator as claimed in claim 1, wherein the first and second capacitors are on-chip capacitors.

3. The low dropout regulator as claimed in claim 1, further comprising a third capacitor coupled between the control terminal and the output terminal of the power transistor.

4. The low dropout regulator as claimed in claim 3, wherein the third capacitor is an on-chip capacitor.

5. The low dropout regulator as claimed in claim 1, wherein the compensating circuit comprises:

a first error amplifier having a first input terminal receiving the feedback of the output voltage, a second input terminal receiving the reference voltage, and an output terminal coupled to the control terminal of the power transistor; and a second error amplifier having a first input terminal coupled to the second output terminal of the current variation sensing circuit, a second input terminal coupled to the first output terminal of the current variation sensing circuit, and an output terminal coupled to the control terminal of the power transistor.

6. The low dropout regulator as claimed in claim 5, further comprising a buffer, wherein the buffer has an input terminal coupled to the output terminal of the first error amplifier and has an output terminal coupled to the output terminal of the second error amplifier.

7. The low dropout regulator as claimed in claim 6, further comprising a fourth capacitor coupled between the input terminal of the buffer and the output terminal of the power transistor.

8. The low dropout regulator as claimed in claim 7, wherein the fourth capacitor is an on-chip capacitor.

9. The low dropout regulator as claimed in claim 5, wherein:

the power transistor is a P channel transistor; and the first input terminal of the first error amplifier operates as a non-inverting input and the second input terminal of the first error amplifier operates as an inverting input.

10. The low dropout regulator as claimed in claim 5, wherein:

the power transistor is a P channel transistor;

the current variation sensing circuit drives the transition speed of the first voltage variation to be faster than that of the second voltage variation; and the first input terminal of the second error amplifier operates as a non-inverting input and the second input terminal of the second error amplifier operates as an inverting input.

11. The low dropout regulator as claimed in claim 1, wherein the compensating circuit comprises a dual input error amplifier which uses overlapped circuits to amplify the first voltage difference between the feedback of the output voltage and the reference voltage and the second voltage difference between the second and the first output terminals of the current variation sensing circuit, respectively, and to sum up the amplified first and second voltage differences to output to the control terminal of the power transistor.

12. The low dropout regulator as claimed in claim 11, further comprising a buffer having an input terminal receiving an output of the dual input error amplifier and having an output terminal coupled to the control terminal of the power transistor.

13. The low dropout regulator as claimed in claim 12, further comprising a fourth capacitor coupled between the input terminal of the buffer and the output terminal of the power transistor.

14. The low dropout regulator as claimed in claim 13, wherein the fourth capacitor is an on-chip capacitor.

15. The low dropout regulator as claimed in claim 12, wherein the compensating circuit further comprises:

a second error amplifier having a first input terminal coupled to the second output terminal of the current variation sensing circuit, a second input terminal coupled to the first output terminal of the current variation sensing circuit, and an output terminal coupled to the control terminal of the power transistor.

16. The low dropout regulator as claimed in claim 15, wherein:

the power transistor is a P channel transistor;

the current variation sensing circuit drives the transition speed of the first voltage variation to be faster than that of the second voltage variation; and the first input terminal of the second error amplifier operates as a non-inverting input, and the second input terminal of the second error amplifier operates as an inverting input.

* * * * *